US005329592A

United States Patent [19]

Altman

[11] Patent Number: 5,329,592

[45] Date of Patent: Jul. 12, 1994

[54] HEADBAND FOR REMOVABLY SECURING STEREO EARPHONES

[75] Inventor: Michaell A. Altman, Atlanta, Ga.

[73] Assignee: Consumer Advantage, Inc., Tucker, Ga.

[21] Appl. No.: 87,607

[22] Filed: Jul. 6, 1993

[51] Int. Cl.[5] ..... H04R 5/00

[52] U.S. Cl. ..... 381/25; 381/74; 2/DIG. 11; 2/209.3; 2/171; 2/422

[58] Field of Search ..... 381/25, 74; 2/DIG. 11, 2/209.3, 171, 422

[56] References Cited

U.S. PATENT DOCUMENTS 4,648,130 3/1987 Kuznetz ..... 2/909
4,665,566 5/1987 Garrow ..... 2/DIG. 11
4,776,044 10/1988 Makins ..... 2/209
4,864,619 9/1989 Spates ..... 381/25
4,918,757 4/1990 Janssen et al. ..... 2/DIG. 11

*Primary Examiner*—Curtis Kuntz
*Assistant Examiner*—Mark D. Kelly
*Attorney, Agent, or Firm*—Jason A. Bernstein

[57] ABSTRACT

A combination headband and stereo earphones having two elongated strips of material releasably attached to each other. The ends of the strips can be attached to form a headband. The wires attached to each earphone are placed in the headband and maintained in place when the strips of the headband are attached to each other. The strips can be imprinted with names, logos and designs for promotional and sponsorship advertising.

8 Claims, 1 Drawing Sheet

HEADBAND FOR REMOVABLY SECURING STEREO EARPHONES

FIELD OF THE INVENTION

The present invention relates to portable earphones and to headbands specifically designed to securely accommodate the earphones.

BACKGROUND OF THE ART

Headbands are well known in the art as lengths of fabric worn about the head to absorb perspiration or to hold back hair. They are typically made of terry cloth or other absorbent fabric, such as cotton, silk, rayon, polyester, fabric blends or other material. Frequently, the terry cloth is knitted with an elastic material.

Many types of headphones and earphones have been developed recently with the explosion of the health and fitness industries to accommodate the active user who demand light weight and comfortable speakers that do not impede movement while remaining in place. One common type is a small, approximately one-half inch diameter earphone that sits outside the ear canal in the folds of the earlobe. The earphone is attached to a length of thin wire. A pair of earphones are used, one for each ear. The wires from each earphone are connected to a male (typically) connector that in turn can be removably connected to a device, such as, but not limited to a cassette or compact disc player, AM/FM radio, dictation machine, musical instrument, or the like. Frequently, these devices are attached to a belt or arm strap or carried by hand.

The earphones are normally placed in the ear with the wire dangling downward. However, earphones can fall out during strenuous activity because the wire does have some weight which pulls downward and also because vigorous movement causes the wires to flop around. Headphones suffer from a similar problem because of their mass and because of the attached antenna that can move.

It would be desirable to have a headband that can accommodate a set of earphones so that the user would be afforded comfort with almost no movement restrictions or concern that the earphones would fall out.

Accordingly, it is a principal object of the present invention to provide a means for maintaining a set of earphones in a relatively fixed position with respect to a user's ear so that the earphones are more comfortably worn.

It is another object of the present invention to provide a headband that can securely hold a pair of earphones and associated wires yet be washable.

It is still another object of the present invention to provide a combination headband and stereo earphone whereby one can imprint names, logos or colors on the headband for use in promotional advertising.

SUMMARY OF THE INVENTION

The present invention overcomes the deficiencies in the art and provides a headband combined with a set of earphones that will conveniently stay on a user's head. More particularly, the present invention provides a combination headband and portable earphones, comprising: a headband comprising an elongated first strip of material and an elongated second strip of material, each of the first and second strips having first and second ends, upper and lower edges and inner and outer faces, the lower edge of the first strip being attached to the upper edge of the second strip, the first end of the first strip being attached to the first end of the second strip, and the second end of the first strip being attached to the second end of the second strip, the inner faces of the first and second strips being releasably attachable to each other, the attached first ends being releasably attachable to the attached second ends; and, a set of earphones comprising a left and right earphone, an electrical wire attached to each of the earphones, and a common connector connecting the wires, whereby the wires can be removably placed between the first and second strips and the strips releasably engaged to each other resulting in the earphones being securely held by the headband and the headband and earphones can be removably worn by a user about a user's head by attaching the first ends to the second ends.

VELCRO or similar hook and loop material is preferably used to attach the material at the inner faces and the ends of the strips. Alternatively, the ends can be attached to each other by a pair of strips of material that can be tied together in a knot. The faces can alternatively be attached together with buttons and matched button holes, snaps, hooks, zippers, and the like. It is also possible for the inner faces of the strips to not be attached, but merely folded together around the earphone wire.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 1:
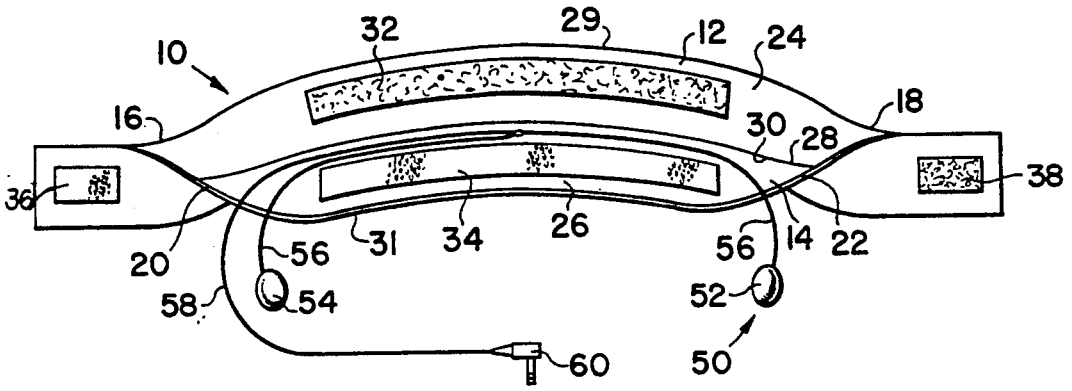
FIG. 1 is a perspective view of a preferred embodiment of the present invention.
Figure 2:
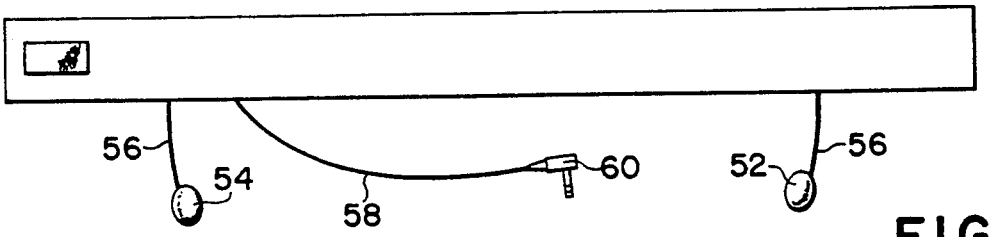
FIG. 2 is a side elevational view of the invention.

Turning to the drawings, FIG. 1 shows a headband 10 having a first strip 12 and a second strip 14 of material. The material is preferably cotton, but is any suitable fabric, such as but not limited to, cotton, terry cloth, silk, polyester, rayon, or blends of these materials. It is preferable that the material of the strip that will be in contact with the user's head be absorbent; therefore, terry cloth will be used in the present discussion, but it is to be understood that any of the above materials can be used. The material of the other strip can be the same or of a different material. It is preferable to have the strip that will not be against the user's head be made of a material that can be imprinted, such as by silk-screening, as will be discussed in detail hereinbelow. The strips 12 and 14 can be of any suitable color, style, width or length.

The first strip 12 has first and second ends 16 and 18. The second strip has first and second ends 20 and 22. The first strip has an inner face 24 and an outer face 25. The second strip has an inner face 26 and an outer face 27 (not shown). The first strip has a lower edge 28 and an upper edge 29. The second strip has an upper edge 30 and a lower edge 31. The lower edge 28 is joined to the upper edge 30, such as by being sewn together. The first ends 16 and 20 are joined together and the second ends 18 and 22 are joined together.

A matable attaching material, such as VELCRO® or other hook and loop system, is preferably used to releasably attach the first strip inner face 24 to the second strip inner face 26. As shown, a strip of hook material 32 is attached to the first strip inner face 24. A strip of loop material 34 is attached to the second strip inner face 26. When pressed together the first and second strips form a pocket.

A strip of hook material 36 is attached to second end 16 and a strip of loop material 38 is attached to first end 16 (shown in phantom). Hook material 36 and loop material 38 are releasably attachable to have the first and second strips 12 and 14 form a loop.

Alternatively, instead of using a hook and loop material, the first and second ends 16, 20 and 18, 22, or the first and second strips 12 and 14 can be attached using button and buttonholes, snaps, zippers and the like. It is also possible to connect the first and second ends using additional strips of material that can be tied together in a knot. The material at the first and second ends can be narrowed so they can be tied into a knot.

An earphone unit 50 comprises a first earphone 52 and a second earphone 54. The earphones 52 and 54 are conventional speakers commercially available and can fit over or in the ear opening. A wire 56 leads from each earphone and the wires are joined at a wire portion 58. A connection plug 60 is attached to the joined wired 58 and is removably connectable to a portable radio, cassette or compact disc player or other device.

In use, the headband 10 is preferably laid out with the inner faces 24 and 26 unattached. The earphone wires 56 are positioned as indicated in FIG. 1 along the seam between the first and second strips 12 and 14 so that the earphones 52 and 54 are below the headband 10. The first and second strips 12 and 14 are attached and the wires 56 are held securely in place.

Figure 3:
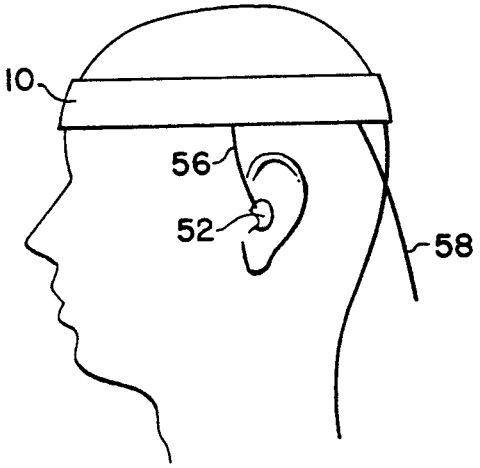
FIG. 3 is a side view of the invention as worn by a user.

The user can then wrap the headband 10 around their head with the earphones 52 and 54 positioned in proximity to each ear and the wire 58 preferably extending downward at the back of the head and down the neck, as shown in FIG. 3. The earphone can then be put in place in the ear and the wires 56 will not become entangled about the user's neck or fall off. Typically, a radio, cassette or compact disk player is carried by hand or strapped around an arm or waist and the connector 60 attached to an outlet in the device (not shown).

An advantage of the present invention is the ease of use compared to using earphones with no retention means. The earphones are held in place by the headband 10 and do not become tangled when tossed into a workout bag. The headband can be detached from the earphones and laundered. The earphones are maintained in position and are less likely to fall out due to gravity and movement during running, turning or other exercise activities. Perspiration is absorbed by the headband 10, thereby reducing the likelihood of moisture entering the earphone or the radio/player.

An additional advantage is that the outer face of one or both strips 12 and 14 can be imprinted with advertising or other designs or words. Many sports equipment manufacturers and event sponsors eagerly seek surfaces upon which they can place their names, logos or colors that will be visible to potential buyers of their products.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

I claim:

1. A headband for securing a set of left and right portable earphones, comprising:

a headband comprising an elongated first strip of material and an elongated second strip of material, each of said first and second strips having first and second ends, upper and lower edges and inner and outer faces, said lower edge of said first strip being attached to said upper edge of said second strip, and said first end of said first strip being attached to said first end of said second strip, and said second end of said first strip being attached to said second end of said second strip, said inner faces of said first and second strips being releasably attachable to each other, said attached first ends being releasably attachable to said attached second ends;

whereby wires attached to the set of left and right portable earphones can be removably placed between said first and second strips and strips releasably engaged to each other resulting in said earphones being securely held by said headband and said headband and earphones can be removably worn by a user about a user's head by attaching said first ends to said second ends.

2. The combination of claim 1, further comprising: a fastening means associated with said inner face of said first strip and a fastening means associated with said inner face of said second strip, both of said fastening means being matably connectable resulting in a releasable attachment when connected.

3. The combination of claim 1, further comprising: a fastening means associated with said first ends and a fastening means associated with said second ends.

4. The fastening means of claim 2, wherein said fastening means comprises a means selected from the group consisting of VELCRO, snaps, buttons, zippers and hooks.

5. The fastening means of claim 3, wherein said fastening means comprises a means selected from the group consisting of VELCRO, snaps, buttons, zippers, hooks and strips of material that can be tied together into a knot.

6. The headband of claim 1, wherein said outer face of said first strip is capable of having an imprint made upon it.

7. The headband of claim 1, wherein said material is fabric.

8. The fabric of claim 7, wherein said fabric is selected from the group consisting of terry cloth, cotton, polyester, cotton and polyester blend, and rayon.

* * * * *